US005384619A

United States Patent [19]

Yokomizo et al.

[11] Patent Number: 5,384,619

[45] Date of Patent: Jan. 24, 1995

[54] IMAGE FORMING APPARATUS HAVING RE-FEEDING UNIT

[75] Inventors: Takao Yokomizo, Machida; Hiroo Kobayashi, Tokyo; Tadashi Yagi, Machida; Hiroshi Yukimachi; Takahiro Azeda, both of Kawasaki; Yoshiro Tsuchiya; Toshifumi Moritani, both of Yokohama; Masahito Ohtsuka, Kawasaki; Tsuyoshi Waragai, Tokyo; Hiroaki Miyake, Yokohama, all of Japan

[73] Assignee: Canon Kabushiki Kaisha, Tokyo, Japan

[21] Appl. No.: 222,369

[22] Filed: Apr. 4, 1994

Related U.S. Application Data

[63] Continuation of Ser. No. 32,553, Mar. 17, 1993, abandoned, which is a continuation of Ser. No. 575,872, Aug. 31, 1990, abandoned.

[30] Foreign Application Priority Data

Aug. 31, 1989 [JP] Japan ..... 1-226910

[51] Int. Cl.[6] ..... G03G 15/00

[52] U.S. Cl. ..... 355/200; 355/309; 355/318

[58] Field of Search ..... 355/200, 318, 319, 24, 355/26, 308, 309; 271/164, 162, 3.1

[56] References Cited

U.S. PATENT DOCUMENTS

| | | | |
|---|---|---|---|
| 4,365,886 | 12/1982 | Murakami et al. | 271/3.1 X |
| 4,587,532 | 5/1986 | Asano | 346/134 |
| 4,605,215 | 8/1986 | Hyltoft | 271/9 |
| 4,639,125 | 1/1987 | Okuda et al. | 355/23 |
| 4,659,207 | 4/1987 | Maekawa | 355/200 X |
| 4,692,022 | 9/1987 | Iwai | 355/24 |
| 4,721,382 | 1/1988 | Ito et al. | 355/309 X |
| 4,803,522 | 2/1989 | Sasaki | 355/26 |
| 4,835,567 | 5/1989 | Ogata | 355/318 |
| 4,855,787 | 8/1989 | Hashimoto et al. | 355/311 |
| 4,864,368 | 9/1989 | Moramatsu | 355/309 |
| 4,905,053 | 2/1990 | Matsuo et al. | 355/319 |
| 4,935,786 | 6/1990 | Veeder | 355/319 |
| 4,975,738 | 12/1990 | Senma et al. | 355/24 X |
| 5,028,041 | 7/1991 | Kobayashi et al. | 271/9 |
| 5,030,991 | 7/1991 | Faitsu et al. | 355/207 |
| 5,049,946 | 9/1991 | Harada | 355/309 |
| 5,083,761 | 1/1992 | Johdai et al. | 271/3.1 |
| 5,132,719 | 7/1992 | Kioka et al. | 355/24 |
| 5,221,951 | 6/1993 | Sakamoto | 355/311 |
| 5,280,331 | 1/1994 | Namiki | 355/318 |
| 5,293,203 | 3/1994 | Wada et al. | 355/309 |

FOREIGN PATENT DOCUMENTS 223854 10/1986 Japan .

*Primary Examiner*—A. T. Grimley
*Assistant Examiner*—Thu A. Dang
*Attorney, Agent, or Firm*—Fitzpatrick, Cella, Harper & Scinto

[57] ABSTRACT

The present invention provides an image forming apparatus with a supply roller for supplying a sheet, a supply path for directing the sheet to an image forming section, a sheet ejecting path for the sheet on which an image is formed at the image forming section toward an ejecting section, a space integrally formed in a lower part of a body of the image forming apparatus, a branch path branched from the sheet ejecting path and adapted to direct the sheet toward the space, an introduction path for directing the sheet from the space to the supply path, and a sheet re-feeing unit removable with respect to the body of the image forming apparatus and including a sheet re-feeding path having an entrance facing the branch path and an exit facing the introduction path.

15 Claims, 15 Drawing Sheets

IMAGE FORMING APPARATUS HAVING RE-FEEDING UNIT

This application is a continuation of application Ser. No. 08/032,553, filed Mar. 17, 1993, now abandoned, which is a continuation of application Ser. No. 07/575,872, filed Aug. 31, 1990, now abandoned.

BACKGROUND OF THE INVENTION

1. Field of the Invention

The present invention relates to an image forming apparatus such as a copying machine, printer or the like, and more particularly, it relates to an image forming apparatus wherein a sheet re-feeding path for the double-surface recording is detachably provided.

2. Related Background Art

In a conventional image forming apparatus such as, for example, a double-surface recording printer (which can record images on both surfaces of a sheet), as shown in FIG. 1, one by one a sheet P is fed from a cassette 1, an image is recorded on the sheet P at an image forming station 3, and the recorded image is fixed on the sheet P at a fixing station 4. Thereafter, the sheet P is ejected or discharged through a sheet feeding path 5 or is deflected by a flapper 6 to be directed to ejector rollers 7 where the sheet is switched-back toward a sheet re-feeding path 8. In the latter case, the sheet passes through the sheet re-feeding path 8 and then is turned over and fed again to the image forming station 3, where an image is recorded on the other surface of the sheet. Thereafter, the image is fixed on the other surface of the sheet at the fixing station 4 and then the sheet P is ejected through the sheet feeding path 5. With this arrangement, in the conventional image forming apparatus, a sheet re-feeding path for the double-surface recording constituted by the flapper 6, ejector rollers 7 and sheet re-feeding path 8 was integrally incorporated into the apparatus, with the result that the sheet re-feeding path for the double-surface recording could not be detached from the apparatus.

Thus, in the past, a single-surface recording printer and a double-surface recording printer were manufactured separately or independently and were not interchangeable to each other.

However, (i) after a user bought a single-surface recording printer, when he desires or needs to perform double-surface recording, there arises a problem that he must newly buy a double-surface recording printer, or (ii) if a user needs to obtain a great number of prints, he must increase a capacity of the cassette into which the sheets are stacked, or must increase a capacity of an ejector tray onto which the recorded sheets are collected. Also, in this case, there arises a problem that he must buy another new printer having the larger capacity.

SUMMARY OF THE INVENTION

The present invention aims to solve the above-mentioned conventional problems, and an object of the present invention is to provide an image forming apparatus wherein a user can freely select a single-surface recording mode or a double-surface recording mode, by detachably providing a sheet re-feeding path for the double-surface recording mode.

Explaining with reference to FIGS. 2, 5 and 6, the present invention provides an image forming apparatus (101) comprising an image forming station (103) for forming an image on a sheet (P) fed from a sheet cassette (117*a*, 117*b*) in which the sheets are stacked, and ejecting path (108) for ejecting the sheet (P) on which the image was formed, and a sheet re-feeding path for the double-surface recording (110) adapted to convey the sheet (P) on which the image was formed toward the image forming station in order to form an image on (the other surface of) said sheet (P), and wherein the sheet re-feeding path for the double-surface recording is formed as a unit and is removably mounted within the image forming apparatus.

According to another feature of the present invention, after the unit of the sheet re-feeding path for the double-surface recording (110) is removed, a cassette (K) in which sheets are stacked can be removably mounted (in place of said unit).

According to a further feature of the present invention, after the unit of the sheet re-feeding path for the double-surface recording (110) is removed, an ejector tray (121) on which the sheets are collected can be removably mounted (in place of said unit).

According to the present invention, since the sheet re-feeding path for the double-surface recording is removable with respect to the body of the image forming apparatus, an image forming apparatus exclusively used for performing the single-surface recording (i.e., a single-surface recording image forming apparatus) can easily be altered or changed to an image forming apparatus which performs the double-surface recording (a double-surface recording image forming apparatus). Accordingly, by preparing the parts common to both the single-surface recording image forming apparatus and the double-surface recording image forming apparatus by the number equal to the total number of the single-surface recording and double-surface recording image forming apparatuses to be obtained and by preparing the sheet re-feeding paths for the double-surface recording by the number equal to the number of the double-surface recording image forming apparatuses to be obtained, the desired number of single-surface recording and double-surface recording image forming apparatus can easily be obtained; thus, the preparation of the parts, the control of the production line and the efficiency of assembling can be-improved. Further, if the user wishes to change the single-surface recording image forming apparatus to the double-surface recording image forming apparatus, since he may buy the sheet re-feeding path for the double-surface recording alone, the user's expense is reduced.

Further, when the user applies the image forming apparatus to the single-surface recording, if the sheet supplying ability is insufficient, such sheet supplying ability can be increased by removing the sheet re-feeding path for the double-surface recording and by alternatively inserting the additional cassette in the apparatus; thus, the user does not need to buy a new image forming apparatus having the larger sheet supplying ability, thereby reducing the user's expense.

Similarly, when the user applies the image forming apparatus to the single-surface recording, if the sheet ejecting ability or sheet collecting ability is insufficient, such sheet collecting ability can be increased by removing the sheet re-feeding path for the double-surface recording and by alternatively inserting the additional ejector tray in the apparatus; thus, the user does not need to buy a new image forming apparatus having the larger sheet collecting ability, thereby reducing the user's expense.

DESCRIPTION OF THE PREFERRED EMBODIMENTS

Figure 1:
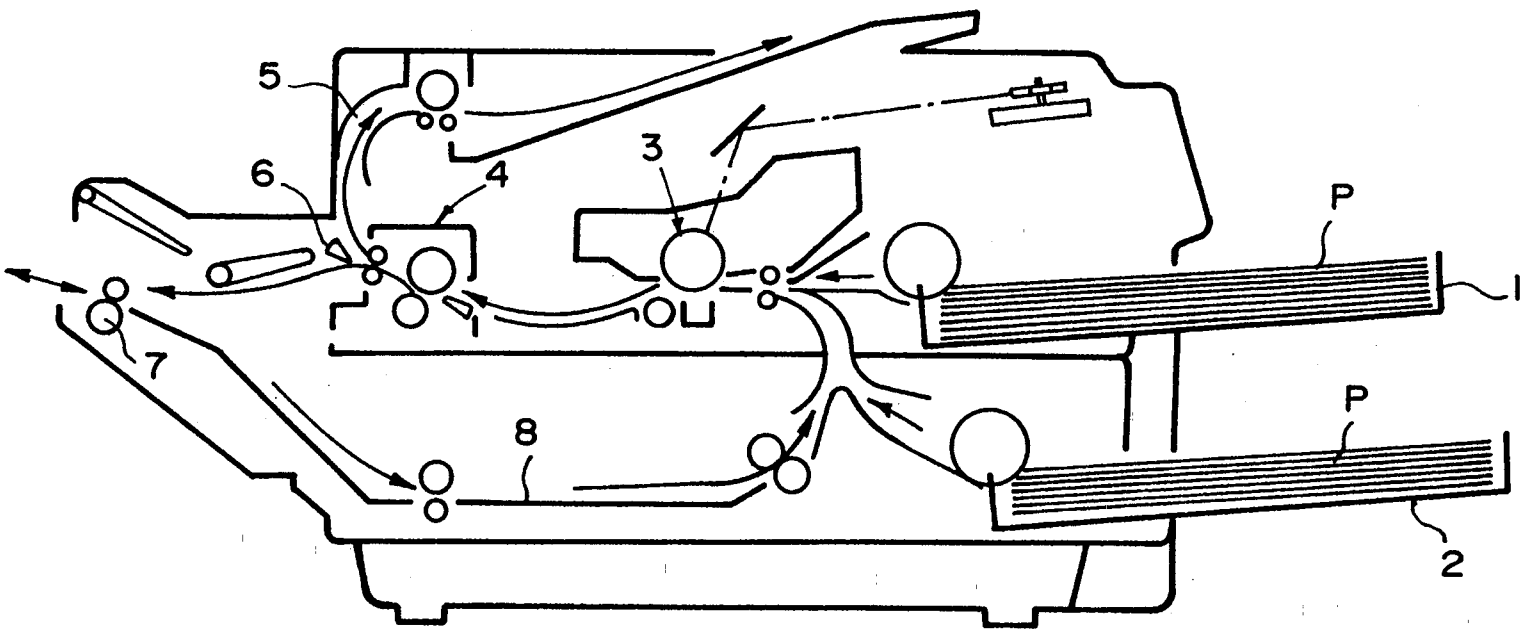
FIG. 1 PRIOR ART
FIG. 1 is an elevational sectional view of a conventional double-surface recording printer.

The present invention will now be explained with reference to the accompanying drawings.

First of all, a preferred embodiment of the present invention will be described in connection with FIGS. 2 to 7.

A double-surface recording printer 101 comprises a body 102, an image forming station 103 disposed centrally within the body 102, a laser scanning station 104 disposed above .and at the right side of the image forming station 103, a sheet supplying station 105 disposed centrally of the right side of the image forming station, and a fixing station 106 disposed at the left side of the image forming station. A flapper 107 is arranged in the vicinity of an outlet of the fixing station 106, and a sheet ejecting path 108 (having a set of ejector rollers **108*a*) extends upwardly from the flapper 107 toward an ejector tray 109 formed on an upper surface of the body 102. The sheet supplying station 105 includes supply rollers 105*a* and a pair of reversible rollers 105*b*, and the image forming station 103 includes a photosensitive drum 103*a* and regist rollers 103*b***.

Figure 4:
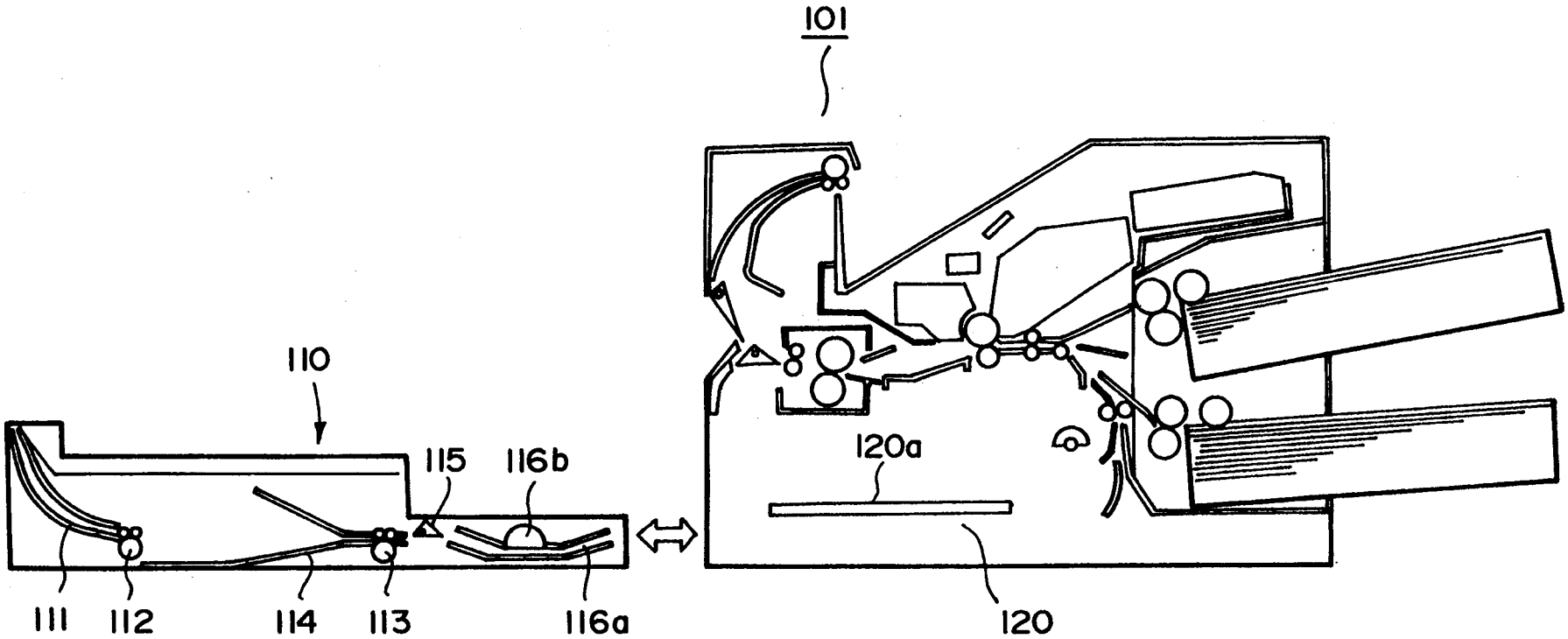
FIG. 4 is an elevational sectional view showing a condition that the sheet re-feeding path for the double-surface recording is removed or dismounted.

A sheet re-feeding path 110 for the double-surface recording (as shown by the hatched area in FIG. 3) is constituted as a unit which can be removed or dismounted from the printer leftwardly, as shown in FIG. 4.

The sheet re-feeding path 110 for the double-surface recording includes an entrance path section 11 extending downwardly from the flapper 107, relay rollers 112 disposed at an outlet of the path section 111, a relay path section 114 including relay feed rollers 113 and extending from the relay rollers 112 to a flapper 115, and a lateral regist roller assembly 116 for correcting the posture of the sheet P fed from the flapper 115. Sheet cassettes **117*a*, 117*b* are removably mounted within the sheet supplying section 105. The lateral regist roller assembly 116 includes an upwardly curved path section 116*a*, a semi-circular roller 116*b*** and a shift means abutting against the lateral edges of the sheet P.

Above and in the vicinity of a central portion of the sheet feeding path 110 for the double-surface recording, a feed roller 118 is rotatably supported by the body 102. The unit with the sheet re-feeding path 110 for the double-surface recording can be removed from an accommodating space 120, and, alternatively, an additional cassette K (FIG. 5) can be inserted into the accommodating space 120. In this case, sheets P stacked in the cassette K are fed one by one by means of the feed roller 118. Incidentally, the accommodating space 120 is integrally formed in a lower part of the body 102 of the printer.

A lower end of a supply path 119 disposed between the sheet supplying section 105 and the image forming section 103 can be communicated with the lateral regist roller assembly 116 and with a sheet cassette which will be described later.

Figure 2:
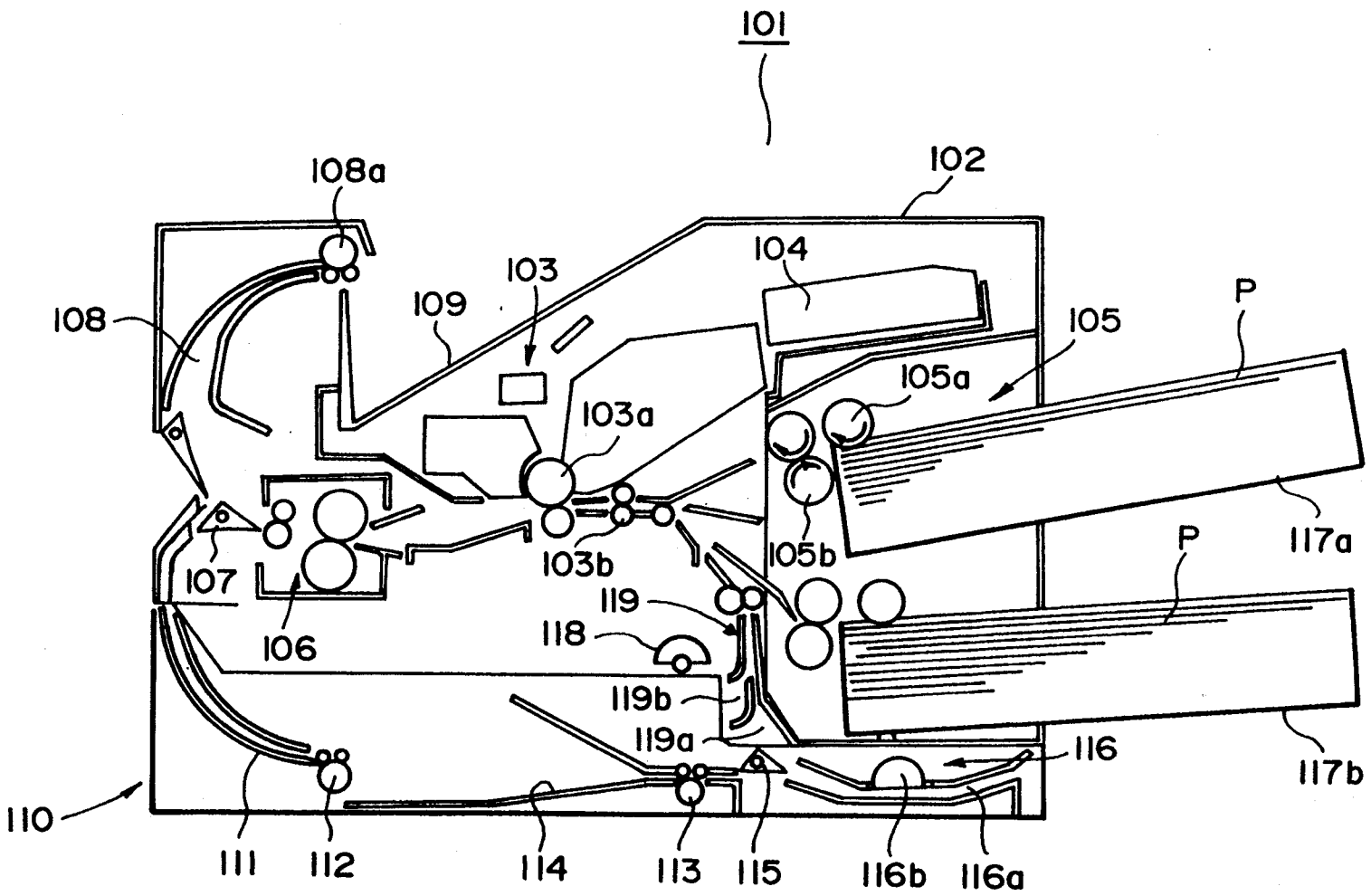
FIG. 2 is an elevational sectional view of an image forming apparatus according to a preferred embodiment of the present invention.
Figure 3:
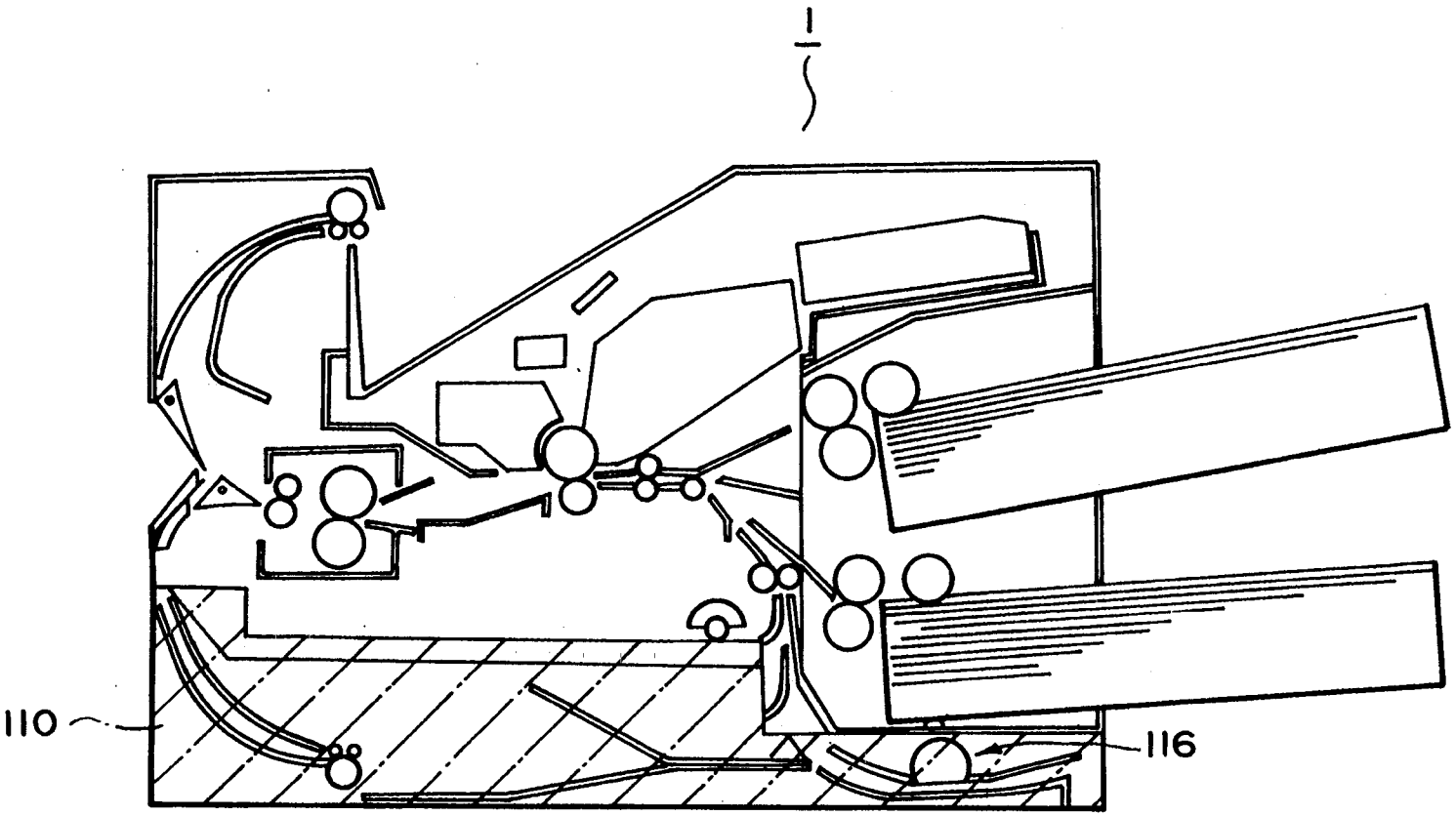
FIG. 3 is an elevational sectional view for explaining a removable sheet re-feeding path for the double-surface recording.

In the illustrated embodiment, since the apparatus has the construction as mentioned above, the sheet P fed from the sheet cassette **117*a* or 117*b* is conveyed through the supply path 119 to the image forming section 103 which is driven with the light from the laser scanning station 104 and where the image is formed on the sheet; then, the image is fixed on the sheet at the fixing station 106, and, thereafter, the sheet is directed, by the flapper 107 positioned as shown in FIG. 2, to the sheet ejecting path 108 to be ejected on the ejector tray 109**. In this case, the image was recorded on the single surface of the sheet.

On the other hand, when the flapper 107 is rotated in an anti-clockwise direction to communicate the fixing station 106 with the entrance path section 111, the sheet P having one surface on which the image has been recorded is fed from the fixing station 106 into the entrance path section 111, and then is directed to the lateral regist roller assembly 116 through the relay path 114. In the lateral regist roller assembly 116, the lateral position of the sheet is corrected, and then the sheet is switched-back by the clockwise rotation of the semi-circular roller **116*b*. Thereafter, the sheet P is again fed to the image forming station 103 through the flapper 115 and the sheet supply path 119, with the other surface (on which the image is not recorded) turned upside. Then, an image is formed on the other surface of the sheet at the image forming station 103. Thereafter, as similar to the above-mentioned manner, the image is fixed on the sheet at the fixing station 106, and, thereafter, the sheet is directed, by the flapper 107 positioned as shown in FIG. 2, to the sheet ejecting path 108 to be ejected on the ejector tray 109**. In this case, the images have been recorded on both surfaces of the sheet.

Figure 5:
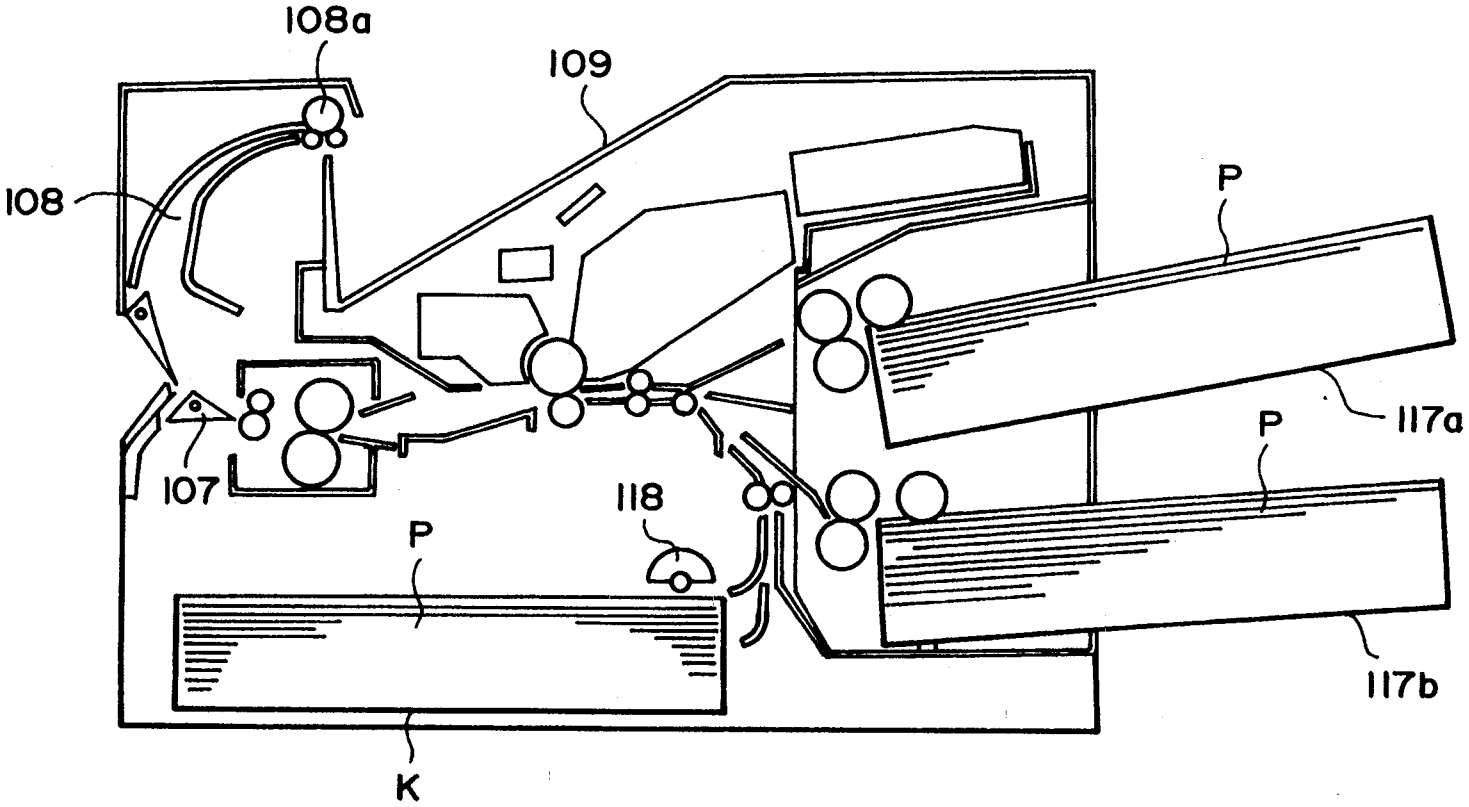
FIG. 5 is an elevational sectional view showing a condition that an additional cassette is installed in place of the removed sheet re-feeding path for the double-surface recording.

Next, when it is desired to obtain a large number of prints each on which the image is recorded on only one surface thereof, if the sheet supplying ability provided by the sheet cassettes 117*a* and 117*b* is insufficient, as shown in FIG. 4, the sheet re-feeding path unit 110 for the double-surface recording is removed from the printer 101, and alternatively, an additional sheet cassette K is inserted into the accommodating space 120, as shown in FIG. 5. In this case, the sheet re-feeding path unit 110 can be moved into and out of the accommodating space 120 while being guided by lateral guides 120*a* formed on the walls of the accommodating space, and the sheet cassette K can be inserted into and removed from the accommodating space in the same manner. Incidentally, the reference numeral 119*b* shown in FIG. 2 denotes an entrance of the sheet supply path 119.

In this way, the sheets P can be supplied from not only the sheet cassettes 117*a*, 117*b* but also the additional sheet cassette K. Thus, the sheet supplying ability is increased.

Figure 6:
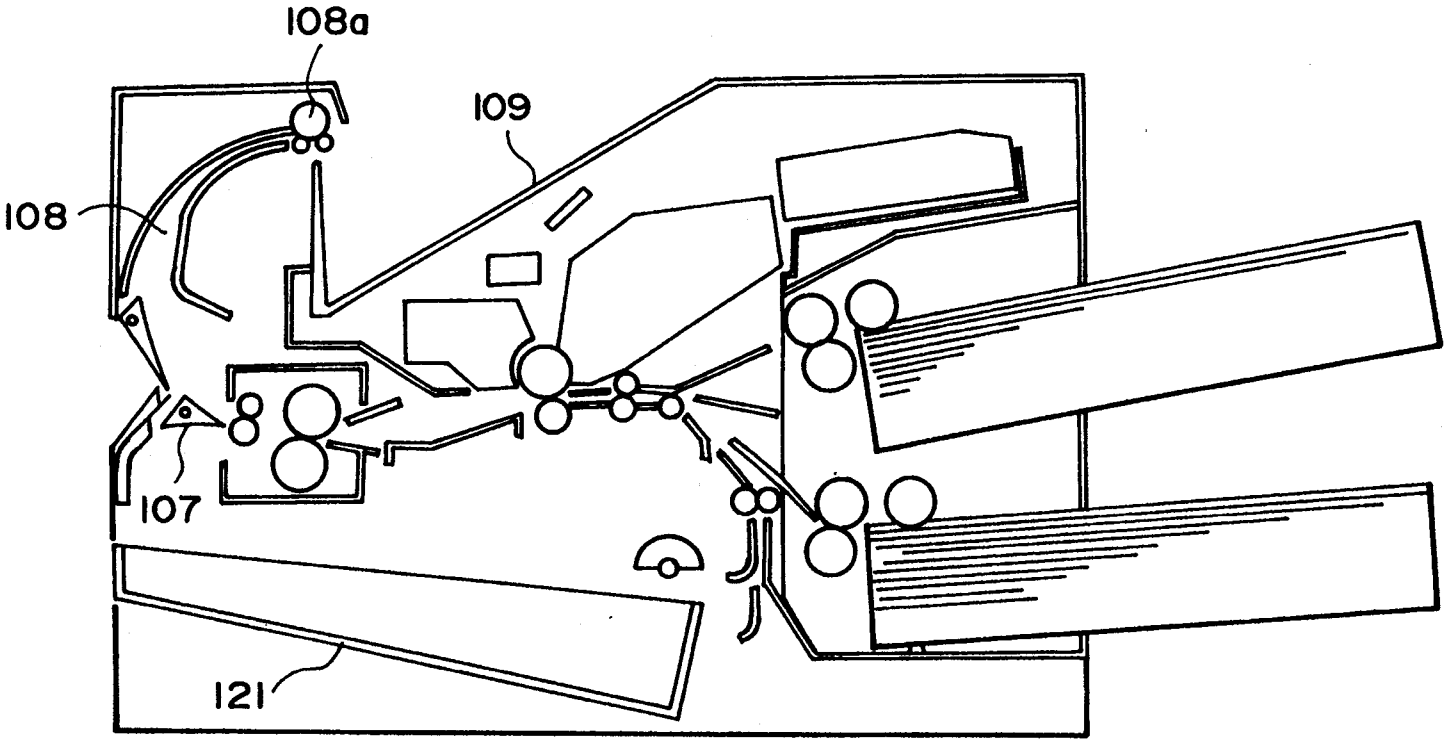
FIG. 6 is an elevational sectional view showing a condition that an additional ejector tray is installed in place of the removed sheet re-feeding path for the double-surface recording.

On the other hand, when it is desired to obtain a large number of prints with the image recorded on only one surface thereof, if the sheet collecting ability provided by the ejector tray 109 alone is insufficient, the sheet re-feeding path unit 110 for the double-surface recording is removed from the printer 101, and alternatively, an additional ejector tray 121 is inserted into the accommodating space 120, as shown in FIG. 6.

In this way, the sheets P each having one surface on which the image was recorded are collected or ejected onto the ejector tray 109 successively from page to page when the flapper 107 is positioned as shown in FIG. 6; whereas, when the flapper 107 is rotated in the anticlockwise direction, the sheets P are collected into the additional ejector tray 121 successively from page to page. The additional ejector tray 121 can be moved into and out of the accommodating space in the same manner as the additional cassette.

Figure 7:
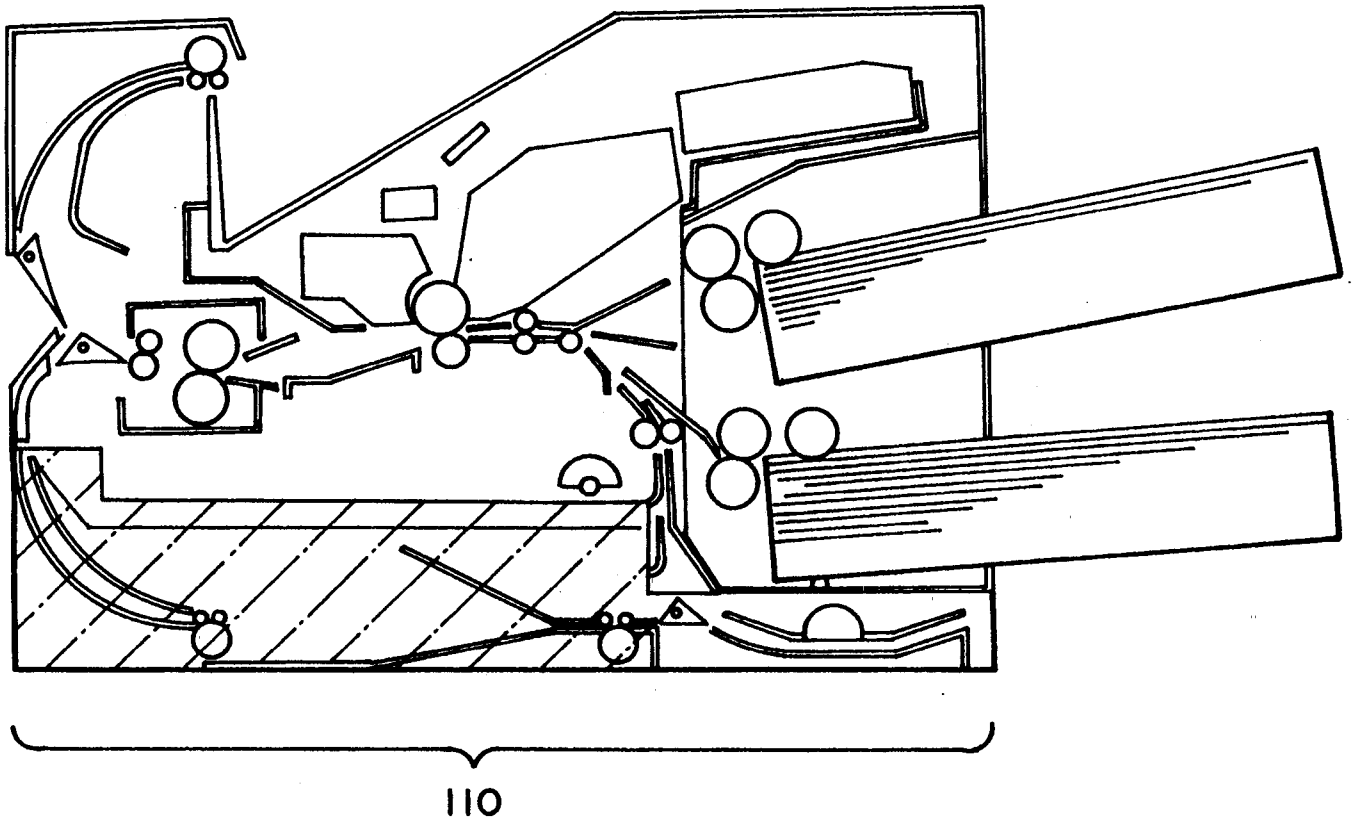
FIG. 7 is an elevational sectional view of an image forming apparatus according to another embodiment of the present invention.

Next, another embodiment of the invention will be explained with reference to FIGS. 7 to 9.

Figure 8:
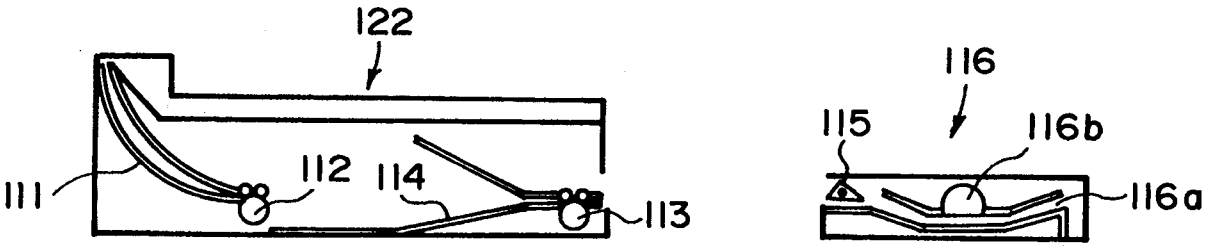
FIG. 8 is an explanatory view showing the sheet re-feeding path for the double-surface recording is divided into two.
Figure 9:
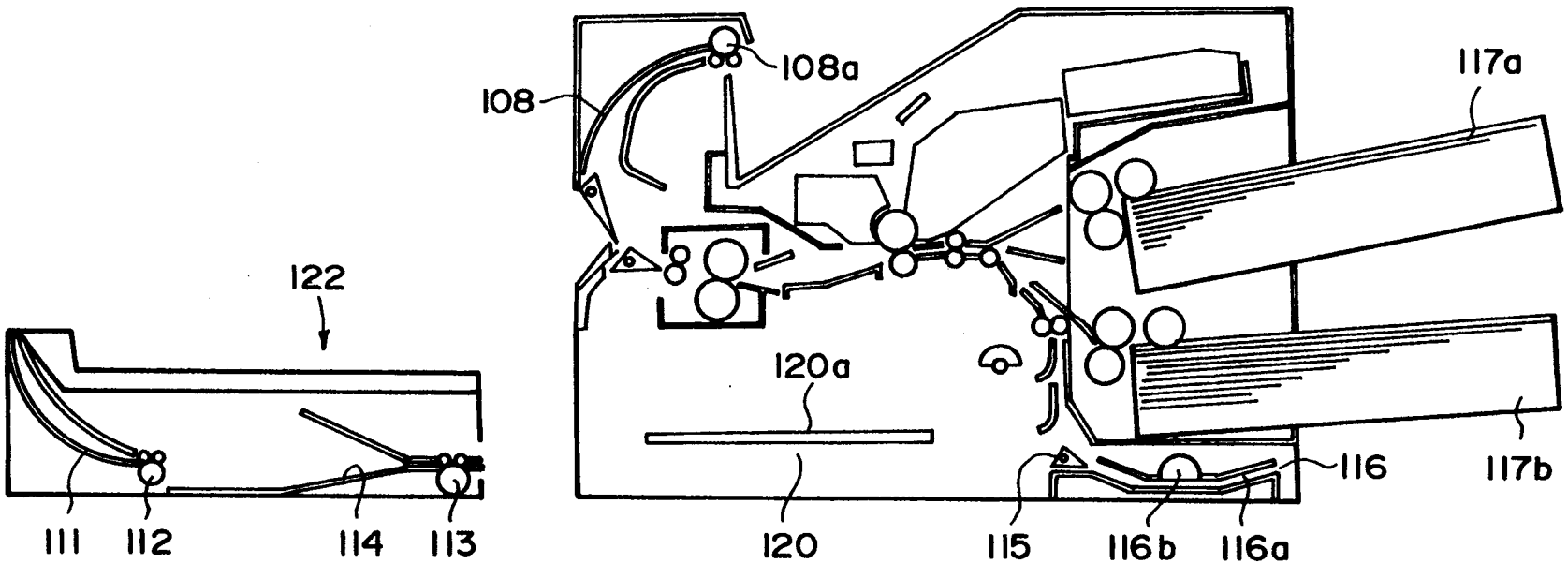
FIG. 9 is an elevational sectional view showing a condition that one of the divided sheet re-feeding path portions for the double-surface recording is removed or dismounted.
Figure 10A:
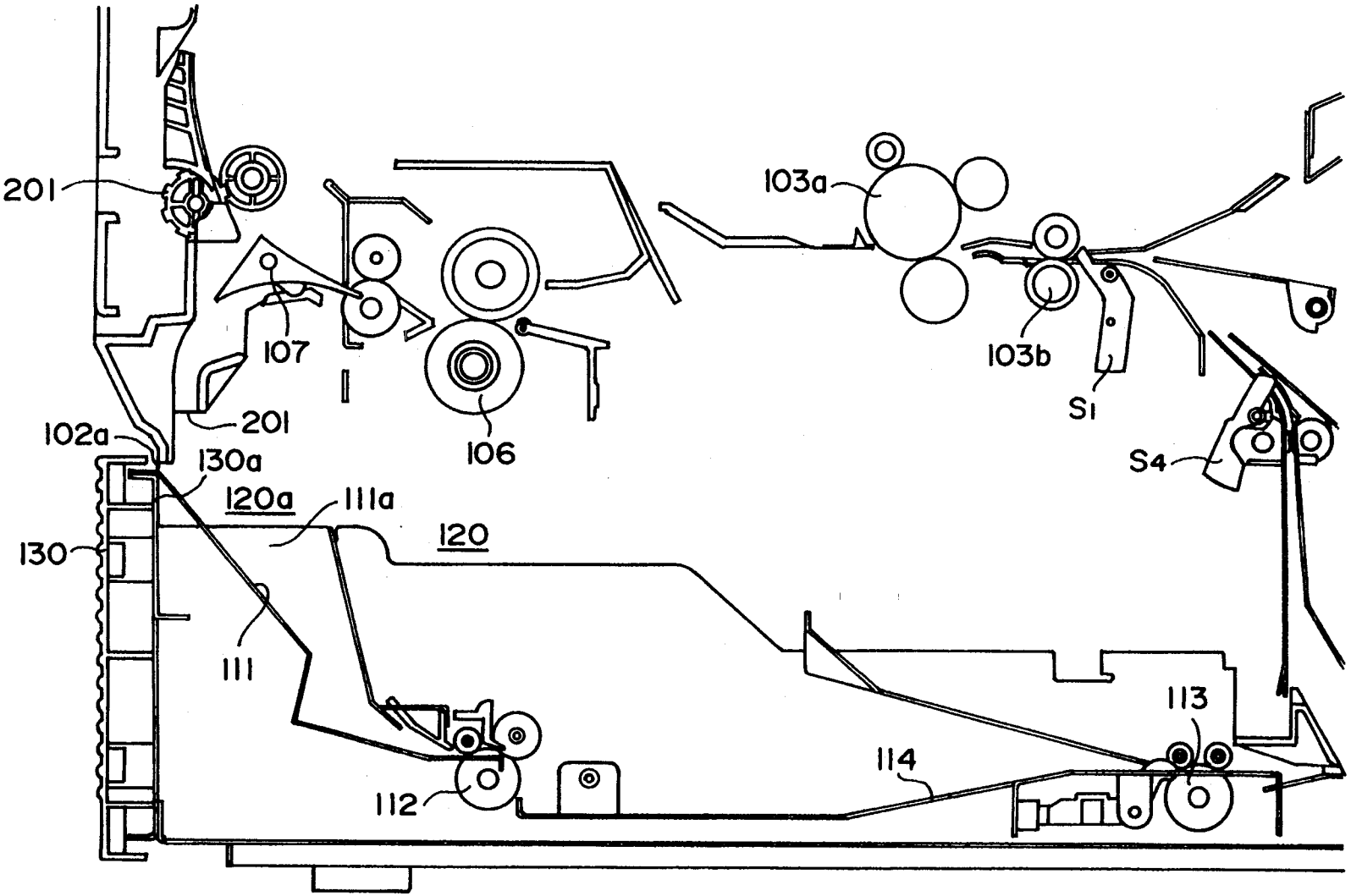
FIGS. 10A and 10B are partial elevational sectional views showing the details of main portions of the apparatus of FIG. 2.
Figure 10B:
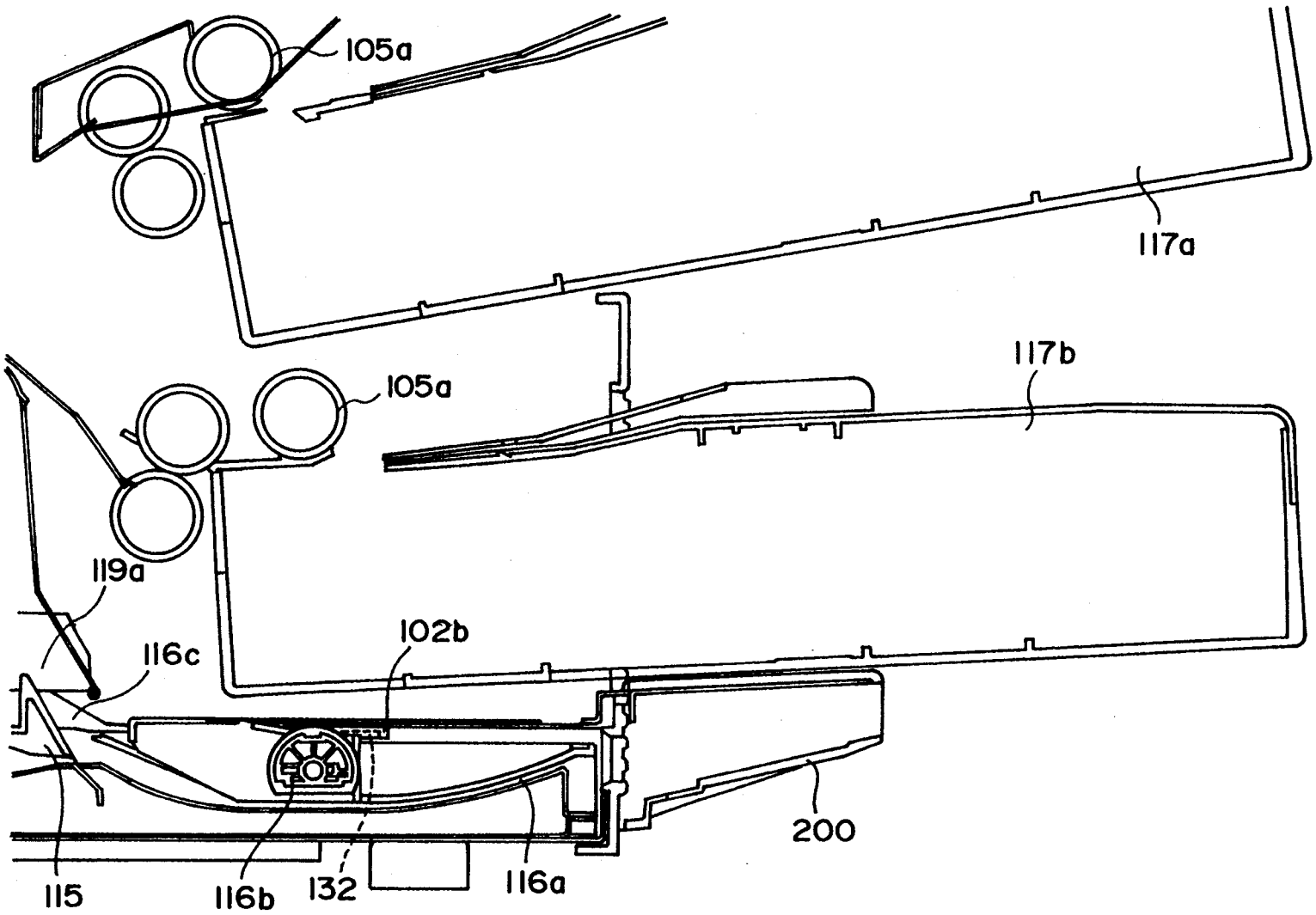
Figure 11A:
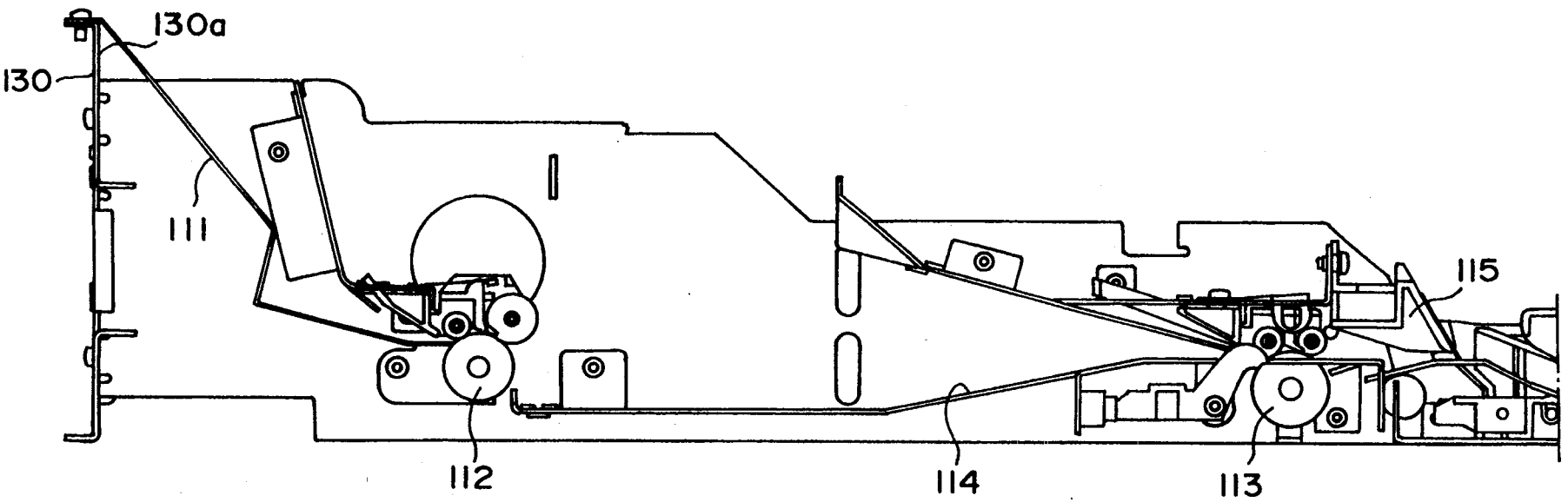
FIGS. 11A and 11B are elevational sectional views showing a condition that the sheet re-feeding path for the double-surface recording is removed.
Figure 11B:
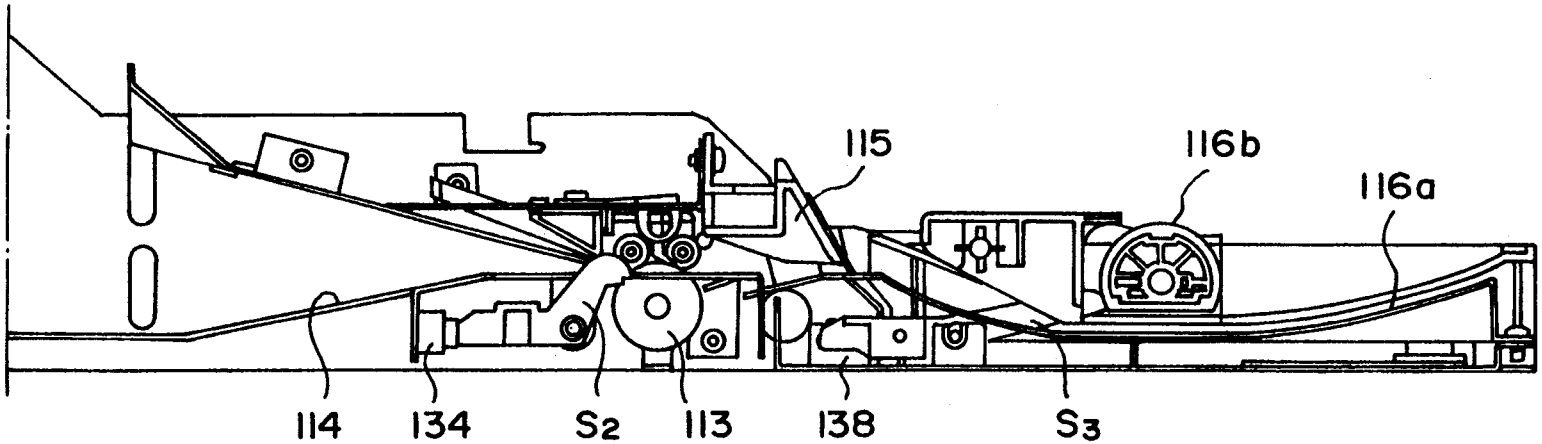
Figure 12A:
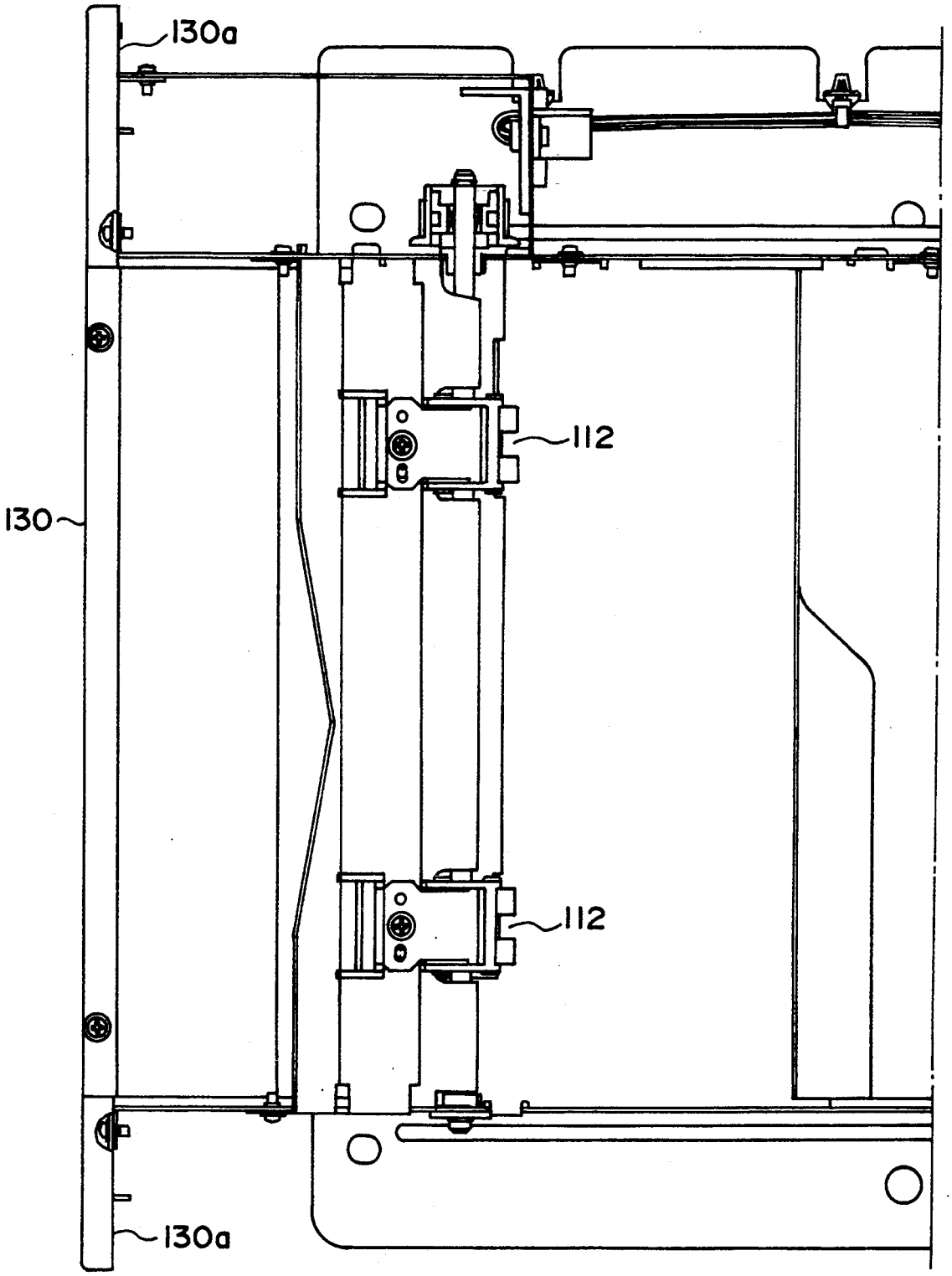
FIGS. 12A and 12B are plan views of the sheet re-feeding path for the double-surface recording.
Figure 12B:
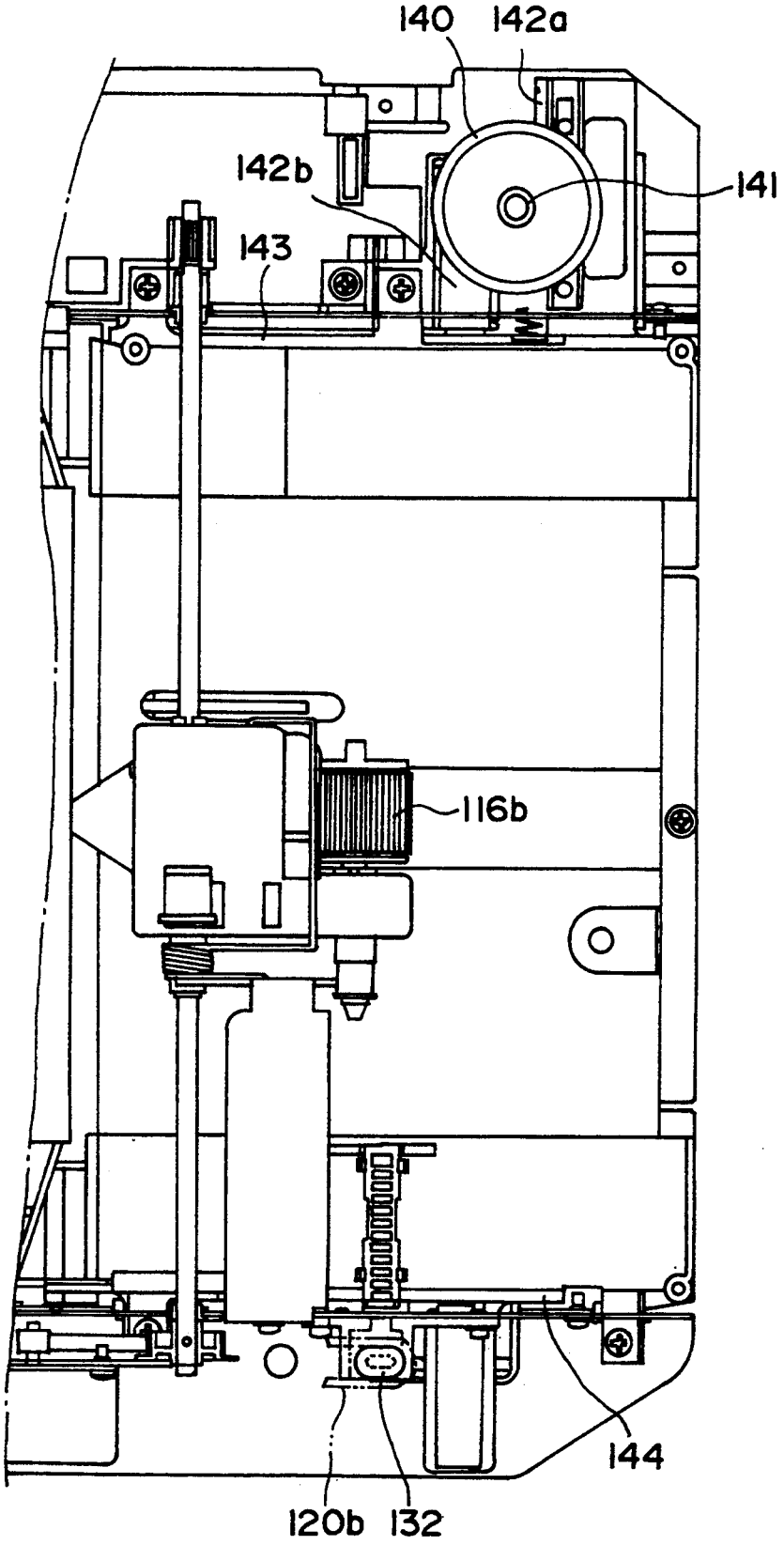
Figure 13:
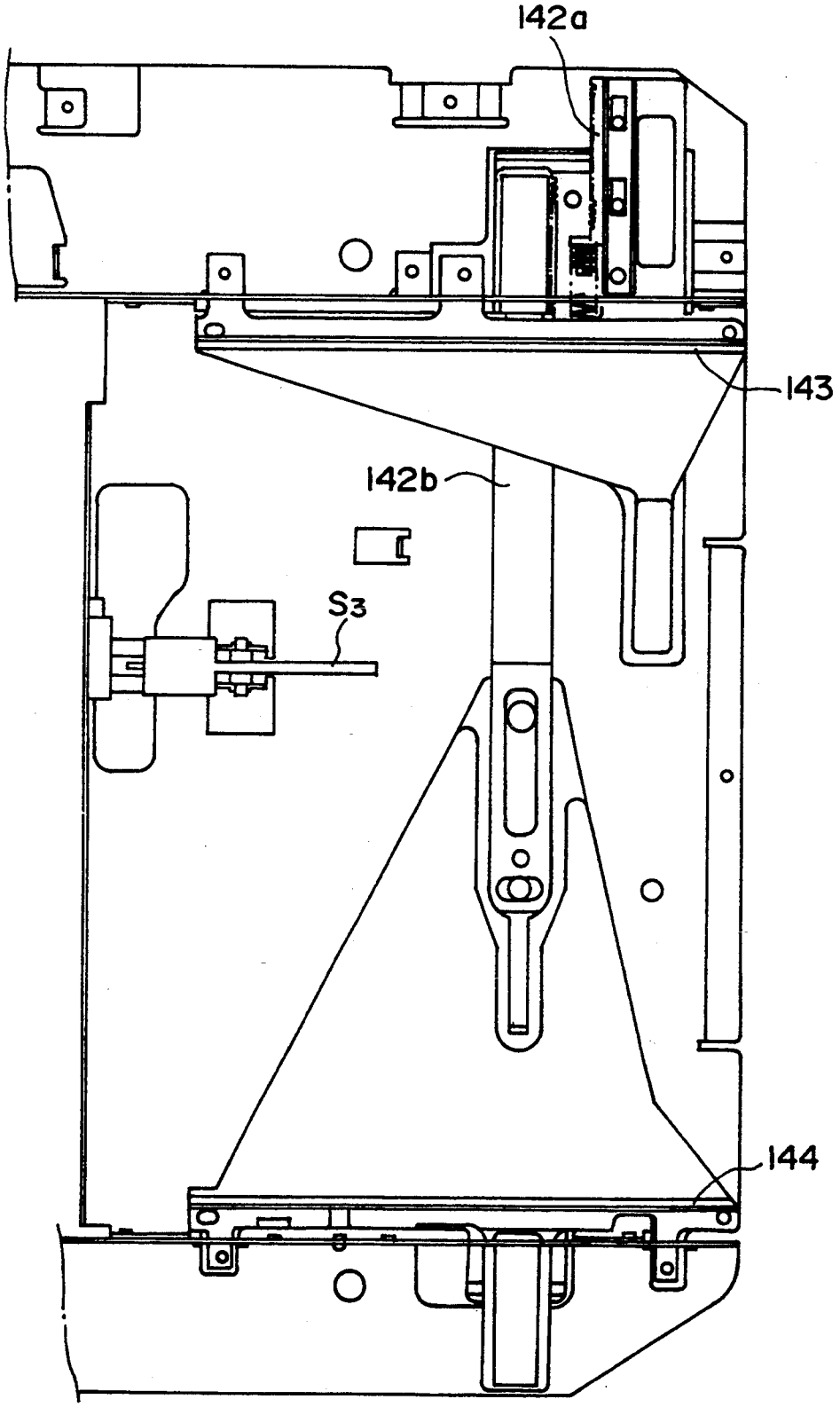
FIG. 13 is a bottom view looked from a direction shown by the arrow A of FIG. 11B.

While, in the previous embodiment, the sheet re-feeding path 110 for the double-surface recording was formed as the unit which was removable wholly, in this embodiment, as shown in FIG. 8, the sheet re-feeding path 110 for the double-surface recording is divided into a lateral regist roller assembly section 116 and a conveying path section 122. Although the lateral regist roller assembly section 116 has a small volume, since it must be positioned with respect to the body 102 of the printer (because it has reference plates for positioning the sheet), it is advantageous that the lateral regist roller assembly 116 is formed integrally with the body 102 (because the relative position between the lateral regist roller and the body is not changed due to the fixed relative relation therebetween). Thus, as shown in FIG. 9, it is so designed that only the conveying path section 122 is removable with respect to the body 102 of the printer.

In this way, the removable part can be simplified. As similar to the previous embodiment, it can be easily understood that, when the conveying section 122 is removed from the accommodating space in the body 102, an additional cassette K or an additional ejector tray 121 can be removably mounted within the accommodating space 120.

Next, the details of the printer of FIG. 2 will be described with reference to FIGS. 10 to 13. Incidentally, the same constructural elements as those shown in FIG. 2 are designated by the same reference numerals and the detailed explanation thereof will be omitted.

The reference numeral 130 denotes a front wall of the sheet re-feeding path unit 110 for the double-surface recording, which wall has a larger area than that of the cross-section of the accommodating space 120. Accordingly, when the sheet re-feeding path unit 110 for the double-surface recording is inserted into the accommodating space 120 from the left, a face 130*a* of the front wall 130 abuts against a side face 102*a* of the body of the printer. With this abutting engagement, the double-surface recording unit 110 is positioned in the insertion direction. When the front wall 130 is attached to the side face 102*a* of the body by means of screws and the like, the double-surface recording unit 110 is fixed with respect to the body of the printer.

The reference numeral 132 denotes a pair of left and right positioning members. Of course, only a single positioning member may be used. The positioning member 132 are disposed substantially on an extension line of a rotation axis of the semi-circular roller 116*b* acting as the re-feeding roller and can be engaged by guides 102*b* formed on the body of the printer. By the engagement between the positioning members 132 and the guides 102*b*, the double-surface recording unit 110, particularly the lateral regist roller assembly thereof is positioned with respect to the body of the printer, particularly the sheet supplying section thereof. That is to say, the sheet reference position in the lateral regist roller assembly is aligned with the sheet reference (side reference or center reference) position in the body of the printer. Thus, the image recording positions on both surfaces of the same sheet are coincident with each other. To this end, the guides 102*b* are arranged in the vicinity of the sheet supplying section. In addition, by the above-mentioned alignment, a path exit 201 of the body of the printer and a path entrance 111*a* of the double-surface recording unit 110 are aligned with each other, and a path exit 116*c* and a path entrance 119*a* of the supply path of the body of the printer are also aligned with each other.

The reference numerals $S_1$ to $S_4$ denote sensors for detecting the coming of the sheet and the passage of the sheet and for controlling the start and stop of rotations of various rollers. Incidentally, when a trailing end of the sheet is detected by the sensor $S_3$, a regist motor 140 is energized to rotate the semi-circular roller.

The reference numeral 200 denotes an auxiliary tray for preventing a leading end of the sheet introduced into the path section 116*a* from depending down. That is to say, since the incoming sheet is not restrained, if there is no means for preventing the sheet from depending down, the sheet will depend from the right end of the path section 116*a* and may be dropped from the path section by its own gravity. The auxiliary tray 200 is fixedly mounted on the body of the printer. Incidentally, the path section is curved upwardly to increase the strength (to be bent) of the sheet and to prevent the sheet from depending down.

The reference numeral 140 denotes the above-mentioned regist roller which can position the sheet against the reference guide by sliding movable guides 143, 144 through a pinion 141 and racks 142. In the illustrated embodiment, the rack 142*a* associates with the movable guide 143 and the rack 142*b* associates with the movable guide 144. By rotating the regist motor 140, the movable guides are shifted in an opposite direction to pinch the sheet therebetween. Accordingly, in this case, the sheet is positioned with the center reference. Of course, the sheet may be positioned with one side reference by shifting one of the movable guides alone.

The sheet feeding unit 110 for the double-surface recording is provided with various motors for driving the rollers therein, the motors being connected to a connector. This connector is coupled to a corresponding connector of the body of the printer when the double-surface recording unit 110 is mounted within the body of the printer. In this way, the double-surface recording unit 110 is electrically connected to the body side of the printer to receive various signals from the printer so that the unit 110 is operated.

I claim:

1. An image forming apparatus comprising:

supply means for supplying a sheet;

a supply path for directing the sheet to an image forming section;

a sheet ejecting path, disposed at an opposite side of said supply path in the horizontal direction with respect to said image forming section, for ejecting the sheet on which an image is formed at said image forming section toward an ejecting section;

a space formed in a lower part of a body of said image forming apparatus, wherein said space is located internally within said body along said supply path and said sheet ejecting path;

a branch path branching from said sheet ejecting path and adapted to direct the sheet toward said space;

an introduction path for directing the sheet from said space to said supply path; and a sheet re-feeding unit of a cassette type contained within said space and removable from said space, said unit being contained in said space to effect copy or multi copy and including a sheet re-feeding path wholly contained within said space and having an entrance facing said branch path and an exit facing said introduction path, wherein, after said sheet re-feeding unit has been removed from said body, a sheet cassette in which the sheets are stacked and from which the sheets are fed to said image forming section is removable mounted alternatively.

2. An image forming apparatus according to claim 1, wherein said sheet re-feeding path comprises switch-back means for introducing the sheet into said entrance from a trailing end of the sheet fed to said switch-back means, and wherein said switch-back means is provided with a path for guiding the sheet along the re-feeding direction.

3. An image forming apparatus according to claim 1, wherein said sheet re-feeding path comprises switch-back means for introducing the sheet into said entrance from a trailing end of the sheet fed to said switch-back means, wherein, at a switch-back portion, said switch-back means includes shift means for positioning the sheet in a lateral direction, and further comprising positioning means for positioning said sheet re-feeding unit with respect to said body of said image forming apparatus in the vicinity of said switch-back portion.

4. An image forming apparatus according to claim 3, wherein a sheet supply section of said image forming apparatus is arranged substantially above said switch-back portion.

5. An image forming apparatus according to claim 2, wherein said switch-back means is constituted as a separate part from said sheet re-feeding path of said sheet re-feeding unit and is fixedly mounted on said body of said image forming apparatus.

6. An image forming apparatus according to claim 5, wherein a portion of said sheet re-feeding unit other than said switch-back means is removably mounted within said body of the image forming apparatus.

7. An image forming apparatus according to claim 6, wherein an exit of said switch-back means faces said introduction path, and said exit of said sheet re-feeding path faces an entrance of said switch-back means.

8. An image forming apparatus according to claim 4, wherein said sheet re-feeding unit has a front wall which can be abutted against a side face of said body of said image forming apparatus to position said sheet re-feeding unit in an insertion direction of said unit.

9. An image forming apparatus comprising:

supply means for supplying a sheet;

a supply path for directing the sheet to an image forming section;

a sheet ejecting path, disposed at an opposite side of said supply path in the horizontal direction with respect to said image forming section, for ejecting the sheet on which an image is formed at said image forming section toward an ejecting section;

a space formed in a lower part of a body of said image forming apparatus, wherein said space is located internally within said body along said supply path and said ejecting path;

a branch path branching from said sheet ejecting path and adapting to direct the sheet toward said space;

an introduction path for directing the sheet from said space to said supply path; and a sheet re-feeding unit of a cassette type contained within said space and removable with respect to said space, said unit being contained in said space to effect copy or multi copy and including a sheet re-feeding path wholly contained within said space and having an entrance facing said branch path and an exit facing said introduction path, wherein, after said sheet re-feeding unit has been removed from said body, an ejector tray in which the sheets are collected is removably mounted alternatively.

10. An image forming apparatus according to claim 1, wherein, after said sheet re-feeding unit has been removed from said body of said image forming apparatus, an ejector tray in which the sheets are collected is removably mountable in place of said sheet cassette.

11. An image forming apparatus according to claim 1, wherein said sheet re-feeding unit is removable along a re-feeding direction of the sheet with respect to said space.

12. An image forming apparatus according to claim 11, wherein said sheet re-feeding unit and said sheet cassette are guided by a common guide upon removal.

13. An image forming apparatus according to claim 11, further comprising a feed roller for feeding the sheet from said sheet cassette therein.

14. An image forming apparatus comprising:

supply means for supplying a sheet;

a supply path for directing the sheet to an image forming section;

a sheet ejecting path, disposed at an opposite side of said supply path in the horizontal direction with respect to said image forming section, for ejecting the sheet on which an image is formed at said image forming section toward an ejecting section;

a space formed in a part of a body of said image forming apparatus, wherein said space is located internally within said body along said supply path and said sheet ejecting path;

a branch path branching from said sheet ejecting path and adapted to direct the sheet toward said space;

an introduction path for directing the sheet from said space to said supply path; and a sheet re-feeding unit of a cassette type contained within said space and removable from said space, said unit being contained in said space to effect copy or multi copy and including a sheet re-feeding path having an entrance facing said branch path and an exit facing said introduction path, wherein, after said sheet re-feeding unit has been removed from said body, a sheet cassette in which the sheets are stacked and from which the sheets are fed to said image forming section is removably mounted alternatively.

15. An image forming apparatus comprising:

supply means for supplying a sheet;

a supply path for directing the sheet to an image forming section;

a sheet ejecting path, disposed at an opposite side of said supply path in the horizontal direction with respect to said image forming section, for ejecting the sheet on which an image is formed at said image forming section toward an ejecting section;

a space formed in a part of a body of said image forming apparatus, wherein said space is located internally within said body along said supply path and said ejecting path;

a branch path branching from said sheet ejecting path and adapting to direct the sheet toward said space;

an introduction path for directing the sheet from said space to said supply path; and a sheet re-feeding unit of a cassette type contained within said space and removable with respect to said space, said unit being contained in said space to effect copy or multi copy and including a sheet re-feeding path having an entrance facing said branch path and an exit facing said introduction path, wherein, after said sheet re-feeding unit has been removed from said body, an ejector tray in which the sheets are collected is removably mounted alternatively.

* * * * *

UNITED STATES PATENT AND TRADEMARK OFFICE

CERTIFICATE OF CORRECTION

PATENT NO. : 5,384,619
DATED : January 24, 1995
INVENTOR(S) : TAKAO YOKOMIZO, ET AL.

It is certified that error appears in the above-indentified patent and that said Letters Patent is hereby corrected as shown below:

On the title page, item [56] "Faitsu et al." should read --Zaitsu et al.--, and Moramatsu" should read --Muramatsu--.

Item [56] line 12, "re-feeing" should read --re-feeding--.

Column 4,
line 4, "section 11" should rad --section 111--.

Column 7,
line 34, "multi copy" should read --multi-copy--.

Column 8,
line 4, "the" should read --said--; and
line 34, "multi copy" should read --multi-copy--.

Column 9,
line 8, "multi copy" should read --multi-copy--.

Column 10,
line 15, "mult copy" should read --multi-copy--.

Signed and Sealed this

Thirteenth Day of June, 1995

Bruce Lehman

*Attest:*

BRUCE LEHMAN

*Attesting Officer*

*Commissioner of Patents and Trademarks*